United States Patent [19]

Haus et al.

[11] Patent Number: 5,044,624

[45] Date of Patent: Sep. 3, 1991

[54] BEARING ARRANGEMENT FOR A PRESSURE ROLLER OF A PRINTER MEANS

[75] Inventors: Rainer Haus, Biebertal; Karl-Heinz Polzer, Mücke, both of Fed. Rep. of Germany

[73] Assignee: Siemens Aktiengesellschaft, Munich, Fed. Rep. of Germany

[21] Appl. No.: 566,382

[22] PCT Filed: Jul. 1, 1988

[86] PCT No.: PCT/DE88/00318

§ 371 Date: Aug. 24, 1990

§ 102(e) Date: Aug. 24, 1990

[87] PCT Pub. No.: WO89/08559

PCT Pub. Date: Sep. 21, 1989

[30] Foreign Application Priority Data

Mar. 15, 1988 [DE] Fed. Rep. of Germany ..... 3808622

[51] Int. Cl.[5] ..... B65H 5/06

[52] U.S. Cl. ..... 271/274; 271/314

[58] Field of Search ..... 271/272, 273, 274, 314

[56] References Cited

U.S. PATENT DOCUMENTS 3,151,551 10/1964 Dutro .
3,205,815 9/1965 Liessem .
3,721,188 3/1973 Jacobsen .
4,431,180 2/1984 Nakajima ..... 271/274
4,461,212 7/1984 Geney ..... 271/264 X
4,850,584 7/1989 Watashi ..... 271/274

FOREIGN PATENT DOCUMENTS 2316156 1/1977 France .
2095193 9/1982 United Kingdom .

*Primary Examiner*—Richard A. Schacher

[57] ABSTRACT

A bearing arrangement for a pressure roller of a printer means in whicht he pressure roller equipped with an elastically deformable surface is fixed in wall parts with rolling bearings at two bearing locations and presses axially and in a radial direction against a coveyor drum with a given pressing power. Of the bearings at both bearing locations, respectively one of the rolling bearings is rigidly arranged in an identically formed bearing housing that comprises self-holding securing elements for the axial fixing of the bearing housing in a recess of the allocated wall part. A locking ring for axially fixing of a bearing neck of the pressure roller in the bearing housing is provided at one bearing location. The corresponding bearing neck at the other bearing location rotates with radial play. The bearing arrangement is suitable for roller pairs that, arranged following one another, for the conveying path of a printer means.

8 Claims, 2 Drawing Sheets

Figure 4:
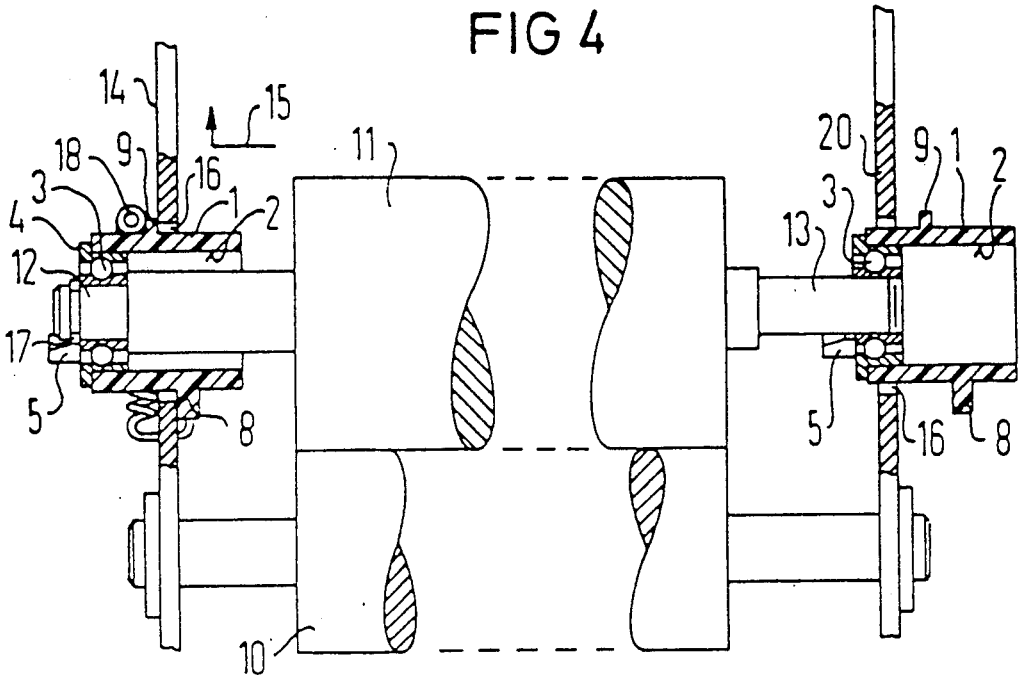

FIG 1
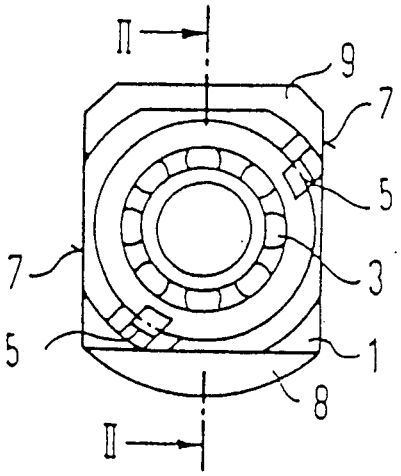
FIG 2
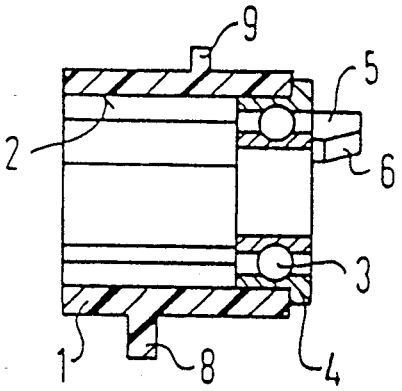
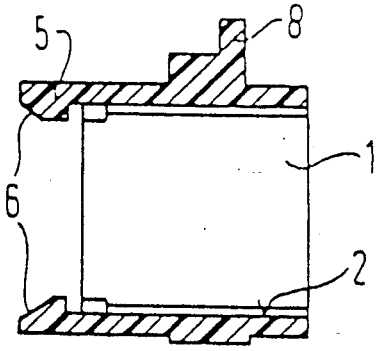
FIG 3

BEARING ARRANGEMENT FOR A PRESSURE ROLLER OF A PRINTER MEANS

The invention is directed to a bearing arrangement for a pressure roller for conveying recording media in a printer means which includes wall parts in which the pressure roller equipped with an elastically deformable surface is axially defined with rolling bearings in two bearing locations and pressing in a radial direction against a conveyor drum with given pressing power.

In order to move recording media, for example single sheets, along a prescribed conveying path in printer equipment, pairs of rollers arranged following one another in the conveying path are frequently utilized as conveyor means, these pairs of rollers being composed of a driven conveyor drum and of an idling pressure roller that presses against the conveyor drum with a given pressing power. One of the two rollers, preferably the pressure roller, has its surface coated with an elastically deformable material in order to be able to intercept tolerances at a given pressing power and in order to uniformly seize the recording medium that runs through between the pair of rollers.

One of the critical problems has thus already been addressed. The pairing of the rollers must be fashioned such that the recording media are reliably seized and conveyed; as warranted, recording media having different material properties, for example different grades of paper having different paper weights, must thereby also be capable of being reliably processed. This is only possible when a given, radial pressing power with which the pressure roller presses against the conveyor drum takes effect in circumferential and axial direction with optimum uniformity.

The roller pairs are often arranged relatively inaccessibly. They should therefore be mounted such insofar as possible that repair or maintenance work is nonetheless easy to carry out. Thus, for example, the pressure rollers that are sensitive because of their elastic surface must be easily replaceable and without special tools insofar as possible, since maintenance work in most instances is carried out at the end user's premises. For space reasons, a mounting and dismantling from side, for example proceeding from the front side of the printer equipment, must be possible for both bearing locations of the roller pairs arranged in wall parts of the printer equipment.

A plurality of such roller pairs are employed in the course of a conveying path in printing equipment, for which reason the bearing structures for the roller pairs in the wall parts must be fashioned as simply as possible for cost reasons, must be composed of few parts, and must be constructed insensitive to tolerances, so that no complicated adjustment work is necessary for assembly. For tolerance reasons, the two bearing location have been differently designed, particularly for the pressure roller. One of the two bearing location forms a fixed bearing that clearly fixes the pressure roller in an axial direction in the respective wall part. The other bearing location, by contrast, is fashioned as a movable bearing in order to intercept manufacture-induced tolerances but also in order to intercept tolerances that are produced by temperature influences during ongoing operations. Despite these different, patly contrary demands, a high operating reliability is particularly desired in order to obtain acceptable maintenance intervals.

It is therefore the object of the present invention to create a bearing arrangement of the species initially cited that, given optimally simple structure having essentially the same structural parts, allows the bearing arrangement to be used both as a movable bearing as well as a fixed bearing, that is simple to assemble and that is insensitive to tolerances in a radial as well as in an axial direction.

In a bearing arrangement of the species initially cited, this object is inventively achieved by one of the rolling bearings at both bearing locations being arranged fixed in an identically fashioned bearing housing that comprises self-holding securing elements for axially fixing the bearing housing in a recess of the allocate wall part; in that one of the bearing locations is fashioned as a fixed bearing and comprises a locking ring for axially fixing a bearing neck of the pressure roller in the bearing housing; and in that the other bearing location fashioned as a movable bearing runs around the corresponding bearing neck with radial play. A critical element of the inventive solution is a bearing housing that can be employed in the same fashion both for the movable bearing as well as for the fixed bearing. This bearing housing accepts identically fashioned rolling bearing fixed in an axial direction, these rolling bearings in turn carrying correspondingly fitted bearing necks of the pressure roller. Another feature of the inventive solution is comprised therein that this bearing housing comprises securing elements that are fashioned such that the bearing housing can be inserted into corresponding recesses of the wall parts of the printer equipment proceeding from one side and, in the assembled condition of the pressure roller, holds itself in an axial direction in non-dislocatable fashion. The movable bearing and the fixed bearing of the pressure roller differ only on the basis of one element, namely a locking ring allocated to the fixed bearing. The corresponding bearing neck of the pressure roller is thus axially fixed in the fixed bearing; by contrast, the corresponding bearing neck is arranged displaceable in an axial direction in the movable bearing.

Developments of the invention provide that, in the bearing arrangement, the recesses in the wall parts are slots and the bearing housing includes guide surfaces arranged at the circumference lying opposite one another and proceeding parallel to one another whose spacing corresponds to the width of the slot; and the securing elements are a pair of catch projections that, lying diametrically opposite one another and being radially salient and spaced in an axial direction from the circumferential surface of the bearing housing, are arranged offset by the thickness of the wall part such that they press against the outside surface or, respectively, against the inside surface of the wall part in the assembled condition.

In addition, the bearing arrangement may have the catch projections arranged on the circumference of the bearing housing turned by a right angle relative to the guide surfaces; and the length of the slot in the wall parts is dimensioned such that eh bearing housing is introducible in an axial direction into the slot. In one embodiment, the bearing arrangement is characterized by the bearing housing comprising a through bore into which the allocated rolling bearing is inserted with its outer raceway that comprises a radially salient collar as a baring surface against the jacket of the bearing housing. In an embodiment of the bearing arrangement, the bearing housing may comprise, adjacent to the seat of the rolling bearing, elastically deformable catch stops that project in an axial direction and that fix the collar of the rolling bearing in an axial direction in the bearing hosing when the rolling bearing is assembled.

Another feature of the invention provides a bearing arrangement that has a tension spring secured to the corresponding wall part that is provided at the bearing locations, this tension spring acting on the bearing housing such that the pressure roller is pressed against the conveyor drum under spring tension. This tension spring, which at least partially loops the bearing housing, may have both ends fixed at the corresponding wall part under prestress.

Further advantages are achieved by the bearing housing being a molded part of plastic. They as well as their advantages shall be set forth in greater detail below in the description of an exemplary embodiment of the invention.

The exemplary embodiment of the invention shall be set forth with reference to the drawing. Thereby shown are: FIG. 1 and FIG. 2 a front view and, respectively, a section through a bearing housing having an introduced ball bearing; FIG. 3 a further sectional view of the bearing housing in a position turned by45° in comparison to the illustration of FIG. 2; FIG. 4 a schematic illustration of the roller pair composed of a conveyor drum and pressure roller, particularly having the two bearing locations for the pressure roller; and FIG. 5 a front view of the fixed bearing of the pressure roller.

FIG. 1 and FIG. 2 show a bearing housing 1 in a front view and, respectively, in a section. This bearing housing is executed as a molded plastic part that comprises a through bore 2. A deep groove ball bearing 3 is inserted in this through bore proceeding from the front side which is visible in FIG. 1. This deep groove ball bearing 3 comprises a collar 4 that is seated on the circumference of the generated surface of the bearing housing 1. The deep groove ball bearing 3 is fixed in the position in the bearing housing 1 shown in FIG. 2 by catch stops 5 that project in the axial direction from the front side of the bearing housing 1 residing diametrically opposite one another. These catch stops 5 are elastically fashioned, so that inwardly directed noses 6 of the catch stops 5 yield in the radial direction when the deep groove ball bearing 3 is inserted and fall in again as soon as the deep groove ball bearing has its collar 4 seated at the circumference of the bearing housing 1. In this position shown in Figs. 1 and 2, the noses 6 of the catch stops 5 embrace the collar 5 of the deep groove ball bearing and fix the latter in the axial direction in the through bore 2 of the bearing housing 1.

FIG. 3 shows the bearing housing 1 in a sectional view as a discrete part. This section of FIG. 3 has been turned by 45° in comparison to its position in the illustration of FIG. 2 in order to be able to show the two catch stops 5 better.

FIG. 1 shows clearest that the bearing housing 1 comprises two guide surfaces 7 that lie opposite one another and are parallel to one another, i.e. the circumference of the bearing housing 1 is not fashioned dynamically balanced but is offset parallel to the plane of section of FIG. 2. As shall be set forth later, the fashioning of a recess in a wall part of the printer equipment that corresponds to the cross section of the bearing housing 1 and that accepts the bearing housing is fixed as a rectangular slot in which the bearing housing 1 is arranged radially displaceable.

Proceeding perpendicularly relative thereto, two catch projections 8 and, respectively, 9 project radially salient from the upper side and, respectively, from the under side of the bearing housing. These catch projections 8 and, respectively, 9 serve as securing elements for axially fixing the bearing housing 1 in the wall parts of the printer equipment. They are therefore arranged offset in the axial direction relative to one another by the wall thickness of the wall parts.

Figure 5:
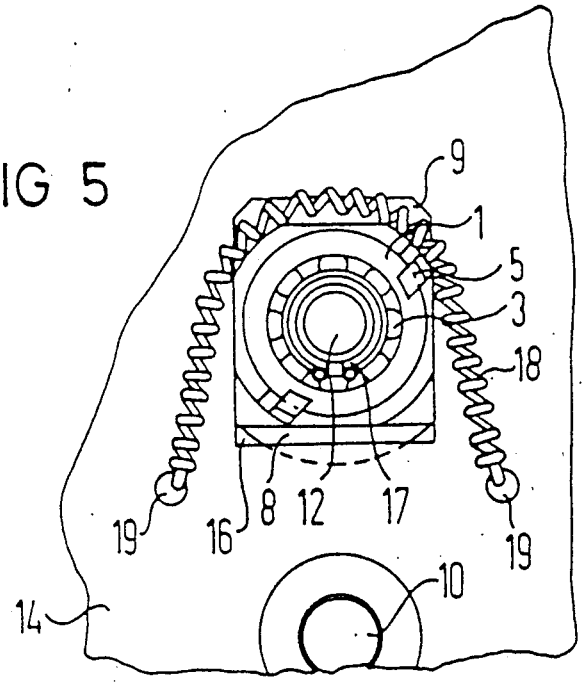

FIG. 4 then shows the overall arrangement of a roller pair composed of a driven conveyor drum 10 and of a freely entrained pressure roller 1!, showing these schematically. By way of addition, FIG. 5 shows a front view of the one bearing location fashioned as a fixed bearing. In the present case, the fashioning and bearing cf the conveyor drum !0 is of subordinate significance; it is therefore not shown in detail. By contrast, the bearing for the pressure roller 11 is executed in detail.

The pressure roller 11 has two bearing necks 12 or, respectively, 13. The one bearing neck 12 of the pressure roller 11 is allocated to the axial fixed bearing of the pressure roller 1 1. This fixed bearing is seated in a schematically indicated, first wall part 14 of the printer equipment that laterally limits the conveying path for a recording medium (not shown). The fixed bearing for the pressure roller 11 arranged in this wall part 14 is shown in the assembled condition.

The wall part 14 comprises a slot-shaped recess 16. This rectangular slot has a width that is slightly greater than the distance of the guide surfaces 7 of the bearing housing from one another. Its length in the direction of the connecting line between the axes of the conveyor drum 10 and of the pressure roller 11 is dimensioned such that the bearing housing 1 including the catch nose 9 is insertable into the recess 16 in the direction of an arrow 15. The bearing neck 12 of the pressure roller 11 introduced into the bearing housing 1 rotates together with the inner raceway of the deep groove ball bearing 3. The bearing neck is secured against axial dislocation by a locking ring 17 that is seated at the outside at the inner raceway of the deep groove ball bearing 3.

A tension spring 18 is also provided, this exerting the radial pressing power with which the pressure roller 11 presses against the conveyor drum 10. This tension spring 18 has its ends hooked into acceptance clearances 19 that are provided in the wall parts, for example 14, at both sides of the bearing slot 16. The tension spring 18 is pulled over the generated surface of the bearing housing 1 under prestress and thus presses the bearing housing 1 in the bearing slot 16 radially in the direction of the axis of the conveyor drum 10.

The arrangement of the movable bearing in a second wall part 20 is shown in its assembled condition for illustrative purposes. In the illustration of FIG. 4, the bearing housing is introduced from the outside, i.e. is again introduced into the corresponding bearing slot 16 i the assembly direction indicated by the arrow 15 until the catch projection 8 of the bearing housing 1 lies against the outside surface of the second wall part 20. The introduced bearing housing 1 is slightly lifted and thus has the catch projection 9 engaging at the inside surface of the second wall part 20. The bent-off shape of the arrow 15 schematically represents this assembly motion. In this assembly of the bearing housing 1 in the second wall part 20, the inner raceway of the deep groove ball bearing 3 is slipped over the second bearing neck of the pressure roller 11. A securing of this bearing neck in axial direction is not provided since the bearing of the pressure roller 11 in the second wall part is intended to form the movable bearing with which manufacturing and temperature tolerances are intercepted.

We claim:

1. A bearing arrangement for a pressure roller having an elastically deformable surface which presses on a conveyor drum for conveying recording media in a printer equipment, comprising:

wall parts in which a position of the pressure roller equipped with the elastically deformable surface is axially defined, rolling bearings in two bearing locations on the pressure roller by which the pressure roller is mounted in the wall parts in a position so that the pressure roller presses in a radial direction against the conveyor drum with a given pressing power, substantially identical bearing housings in which said rolling bearings at said two bearing locations are fixed, each of said substantially identical bearing housings comprising:

self-holding securing elements for axially fixing the bearing housing in a recess of the allocated wall part;

a locking ring mounted at one of the two bearing locations which serves as a fixed bearing, the locking ring being mounted to axially fix a bearing neck of the pressure roller in a corresponding one of the bearing housings; and the other of the two bearing locations serving as a movable bearing and extending around a corresponding bearing journal of the pressure roller with radial play.

2. A bearing arrangement according to claim 1, wherein the recesses in the wall parts are slots, and the bearing housing comprises guide surfaces arranged at a circumference of the bearing housing lying opposite one another and proceeding parallel to one another whose spacing corresponds to a width of the slot; and the securing elements are a pair of catch projections that, lying diametrically opposite one another and radially salient and spaced in an axial direction from the circumferential surface of the bearing housing, are offset such by a thickness of the wall part that they press against a surface of the wall part when assembled in the wall parts.

3. A bearing arrangement according to claim 2, wherein the catch projections are on the circumference of the bearing housing by a right angle relative to guide surfaces; and the slot in the wall parts is of a length is such that the bearing housing is introducible in an axial direction into the slot.

4. A bearing arrangement according to claim 1, wherein the bearing housing comprises a through bore into which an allocated one of the rolling bearings is mounted, the rolling bearing having an outer raceway that comprises a radially salient collar serving as a bearing surface against the bearing housing.

5. A bearing arrangement according to claim 4, wherein the bearing housing comprises—adjacent to a seat of the rolling bearing —elastically deformable catch stops that project in an axial direction and that fix a collar of the rolling bearing in an axial direction in the bearing housing when the rolling bearing is assembled.

6. A bearing arrangement according to claim 1, further comprising:

a tension spring secured to a corresponding one of the wall parts at the bearing locations, said tension spring bearing against the bearing housing such that the pressure roller is pressed against the conveyor drum under spring tension.

7. A bearing arrangement according to claim 6, wherein the tension spring—at least partially looping the bearing housing—has both ends fixed at the corresponding wall part under prestress.

8. A bearing arrangement according to claim 1, wherein the bearing housing is a molded part of plastic.

* * * * *